US006212853B1

(12) United States Patent
Yuyama et al.

(10) Patent No.: US 6,212,853 B1
(45) Date of Patent: Apr. 10, 2001

(54) SEALING DEVICE FOR MEDICATION PACKING MACHINE

(75) Inventors: Hiroyuki Yuyama; Keita Yasuoka, both of Toyonaka (JP)

(73) Assignee: Yuyama Mfg. Co., Ltd., Toyonaka (JP)

( * ) Notice: Subject to any disclaimer, the term of this patent is extended or adjusted under 35 U.S.C. 154(b) by 0 days.

(21) Appl. No.: 09/349,935

(22) Filed: Jul. 8, 1999

(30) Foreign Application Priority Data

Jul. 9, 1998 (JP) ..... 10-194298

(51) Int. Cl.[7] ..... B65B 9/02; B65B 9/06; B65B 9/08; B65B 57/10

(52) U.S. Cl. ..... 53/66; 53/550; 53/553; 53/55

(58) Field of Search ..... 53/550, 553, 66, 53/55

(56) References Cited

U.S. PATENT DOCUMENTS

| | | | | |
|---|---|---|---|---|
| 4,549,386 | * | 10/1985 | Wilson | 53/550 |
| 4,733,362 | * | 3/1988 | Haraguchi | 53/75 |
| 5,524,413 | * | 6/1996 | Fukuda | 53/64 |
| 5,839,257 | * | 11/1998 | Soderstrom et al. | 53/550 |
| 5,945,651 | * | 8/1999 | Chorosinski | 235/375 |

FOREIGN PATENT DOCUMENTS 8-230832 9/1996 (JP) .

9-202301 8/1997 (JP) .

* cited by examiner

*Primary Examiner*—S. Thomas Hughes
*Assistant Examiner*—Eric Compton
(74) *Attorney, Agent, or Firm*—Wenderoth, Lind & Ponack, L.L.P.

(57) ABSTRACT

A sealing device for a medication packing machine comprises memory means for storing a bag length setting file and a maximum containable medication quantity setting file. The bag length setting file contains, for each of said different bag lengths of said packing bags, a maximum medicament quantity ratio which means a ratio of the maximum quantity of standard medication containable in each packing bag with respective bag length to the maximum quantity of standard medication containable in a standard packing bag. The maximum containable medication quantity setting file contains a maximum quantity of each of other medication containable in said standard bag. A maximum containable medication quantity is read from said maximum containable medication quantity setting file on the basis of the type and quantity of medication for each medication-taking time in prescription data. A sum of containing rate of the medicament in the standard bag is calculated. Then, a bag length is determined on the basis of the sum of containing rate and the maximum medicament quantity ratio stored in said bag length setting file. The medication bag is sealed in said bag length and the medication is packed in the medication bag.

3 Claims, 6 Drawing Sheets

Fig.6

1998. 04. 22

<PRESCRIPTION DATA INPUT>

| | | | |
|---|---|---|---|
| PATIENT CODE | 93026671 | EXCHANGE NO. | 1234 |
| PATIENT NAME (IN ALPHABET) | YAMADA TAROU | DIAGNOSIS / TREATMENT DEPARTMENT | 01 INTERNAL MEDICINE |
| PATIENT NAME (IN CHINESE CHARACTER) | 山田　太郎 | PHYSICIAN | 0102 川上　花子 |
| SEX | MALE | | |
| BIRTH DATE | 1945.05.06 | | |
| AGE | 052YEARS OLD 11 MONTHS | | |

| PRESCRIPTION NO. | CODE | MEDICATION NAME / USAGE DIRECTION | DOSE | TAKING TIME | | | |
|---|---|---|---|---|---|---|---|
| | | | | MORNING | MIDDAY | EVENING | BEFORE SLEEP |
| 1 | TAB A / 301 | TABLET A / SEPARATION 3<br>AFTER MORNING, MIDDAY AND EVENING MEALS FOR 7 DAYS | 3 TABLETS | 1 | 1 | 1 | 0 |
| 2 | TAB B / 201 | TABLET B / SEPARATION 2<br>AFTER MORNING AND EVENING MEALS FOR 7 DAYS | 4 TABLETS | 2 | 0 | 2 | 0 |
| 3 | CAP C / 103 | CAPSULE C / SEPARATION 1<br>AFTER EVENING MEAL FOR 7 DAYS | 3 CAP | 0 | 0 | 3 | 0 |

NEW INPUT　INPUT OK　CANCEL

SEALING DEVICE FOR MEDICATION PACKING MACHINE

TECHNICAL FIELD OF THE INVENTION

The present invention relates to a sealing device for a medication packing machine for use in medical institutions such as hospitals and dispensing pharmacies.

BACKGROUND OF THE INVENTION

In a typical medication packing machine, each distributed medication is packaged in a heat-fusible packing sheet using a sealing device.

Various sealing devices of the above type for use with tablet medication packing machines have been known. For example, Japanese Patent Laid-Open No. 8-230832 discloses a sealing device capable of freely changing the size of packing bags. In addition, Japanese Patent Laid-Open No. 9-202301 discloses a sealing device capable of changing the size of packing bags according to the volume of tablets to be packed.

Such sealing devices, however, have some problems. First, determination of the size of the packing bag based on a calculation result of the volume of a tablet inevitably requires volume data for each tablet. It is therefore difficult to put the foregoing prior art devices to practical use. The reason is that there are various types of medications (e.g., tablet, capsule, powder and so on), each type varying in shape and size. For instance, some medications have the form of an ellipse and other medications have the form of a hexagon. Accordingly, enormous volumes of data are required in determining the size of packing bags. Besides, in the case of packing a plurality of tablets or different kinds of medications in each packing bag, it is required to take dead spaces or the like into consideration. Therefore, it is extremely difficult to find the size of the packing bag by performing arithmetic on the basis of only the volume of each medication. For this reason, it becomes necessary to examine packing results to accumulate knowledge of how to set volume information depending on the medication shape, size, and combination, which is very labor-consuming. In addition, in such a method of determining a packing bag's size, it is impossible to make changes, unless the control program is changed. Accordingly, it is impossible to flexibly deal with differences in the type and quantity of medication to be packaged. Furthermore, since the control program itself is stored in read-only memory (ROM), replacement of the control program becomes necessary.

Additionally, after the packing operation, it is necessary to make sure that the type and quantity of medications packaged in individual packing bags is correct. However, if the packing bags are different in bag length between each medication-taking time ("MORNING", "MIDDAY", and "EVENING"), such confirmation of whether the type and quantity of medication packaged is correct or not is difficult to make. In addition, when trying to fold an elongated series of packing bags of different lengths, and to put same into a medication envelop, it is hard to actually fold the series of packing bags because the positions of perforation lines, along which folding can be carried out easily, are not aligned with one another (irregular alignment). This accordingly results in poor workability. If folding is carried out at a wrong position other than a line of perforations, this may cause separation at a wrong position by mistake.

SUMMARY OF THE INVENTION

Accordingly, an object of the present invention is to provide a sealing device for a medication packing machine capable of readily assigning to a packing bag an adequate bag length corresponding to the type and quantity of medication to be compartment-packaged.

The present invention provides, as a solution to the above-described problem with the prior art, a sealing device for a medication packing machine in which an elongated packing sheet is fed in a longitudinally double-folded state and is sealed widthwise at longitudinal space intervals to form packing bags which are identical in bag width but different in bag length, for packing of medication in each of said packing bags, said sealing device comprising:

(a) memory means for storing a bag length setting file and a maximum containable medication quantity setting file, said bag length setting file containing, for each of said different bag lengths of said packing bags, a maximum medicament quantity ratio which means a ratio of the maximum quantity of standard medication containable in each packing bag with respective bag length to the maximum quantity of standard medication containable in a standard packing bag.

said maximum containable medication quantity setting file containing a maximum quantity of each of other medication containable in said standard bag, (b) control means for reading a maximum containable medication quantity from said maximum containable medication quantity setting file on the basis of the type and quantity of medication for each medication-taking time in prescription data, calculating a sum of containing rate of the medicament in the standard bag, determining a bag length on the basis of said sum of containing rate and said maximum medicament quantity ratio stored in said bag length setting file, and sealing the medication bag in said bag length and packing said medication in said medication bag.

It is preferred that data contained in each of the files stored in the storage means can be changed by input means.

It is also preferred that the calculated bag lengths, i.e., the results of the calculations, are brought to one unified value equal to the maximum of the calculation results and all packing bags are formed having a bag length corresponding to the maximum value.

BRIEF DESCRIPTION OF THE DRAWINGS

Further objects and advantages of the present invention will be become clear from the following description taken in conjunction with the preferred embodiments thereof with reference to the accompanying drawings, in which:

FIG. 6 is an input screen of a CRT display with prescription data displayed thereon.

DETAILED DESCRIPTION OF THE INVENTION

Figure 1:
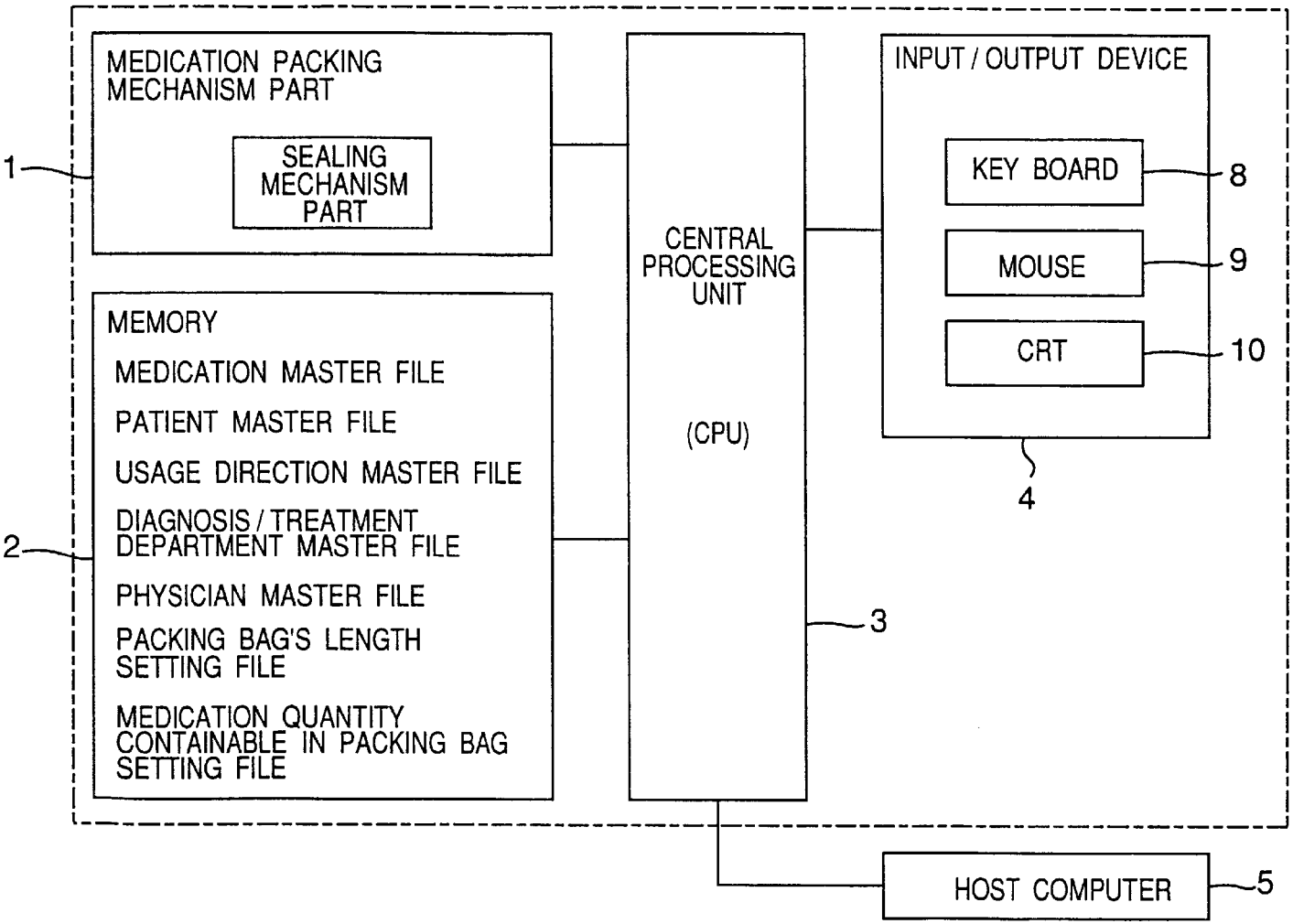
FIG. 1 is a block diagram of a sealing device in accordance with an embodiment of the present invention.

Referring first to FIG. 1, there is shown in block form a sealing device for use with a medication packing machine in accordance with an embodiment of the present invention. This sealing device roughly comprises a medication packing mechanism part 1, a memory device 2, a central processing unit (CPU) 3, and an input/output (I/O) device 4. The CPU 3 is coupled to a host computer 5.

Figure 2:
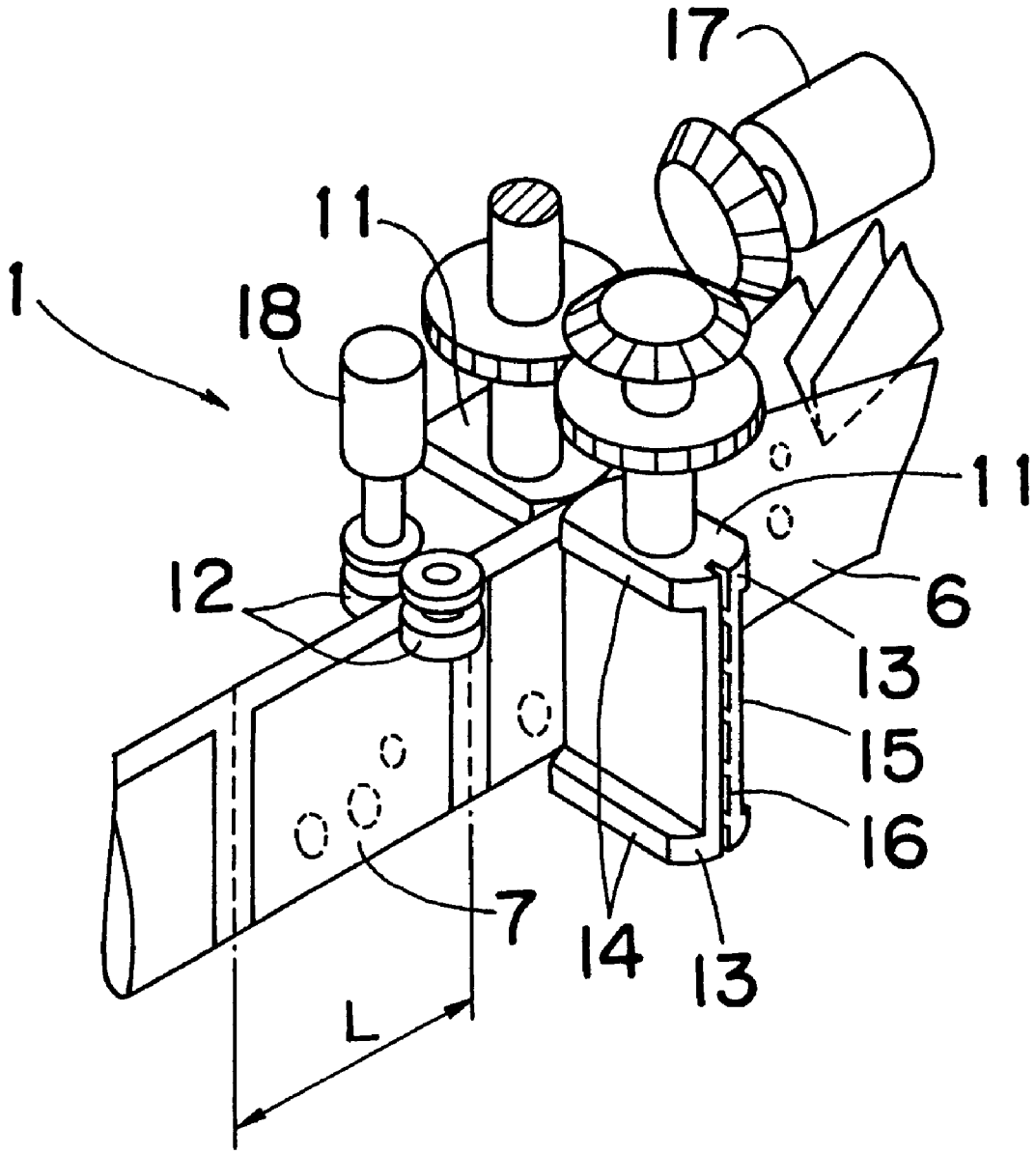
FIG. 2 is a perspective view of a medication packing mechanism part of FIG. 1.

As shown in FIG. 2, the medication packing mechanism 1 comprises first heat rollers 11 and second heat rollers 12. Each of the first heat rollers 11 has, in its both ends, circumferential surfaces 13 opposite to each other, straight surfaces 14 opposite to each other. Each of the first heat rollers 11 has also heating surfaces 15 extending between the circumferential surfaces 13 in both ends and perforation cutters 16 provided in the heating surfaces 15. The first and second heat rollers 11, 12 are connected to drive motors 17, 18, respectively. In the medication packing mechanism part 1, a wound-around, elongated packing sheet 6 is longitudinally double-folded. The packing sheet 6 is heat-fused in the direction of the width thereof at predetermined, longitudinal space intervals by heating surfaces 13 of the first heat rollers 11, simultaneously formed with perforations by the perforation cutters 15. After placement of medication, the packing sheet 6 is heat-fused at its side openings for packing of medication units in each packing bag 7 by the second heat rollers 12.

When the first rollers 11 is stopped in a state that the straight surface 14 of each heating roller 11 is opposed to each other and the second heat rollers 12 is driven to control conveyance quantity of the packing sheet 6 by the second rollers 12, the bag length L of the packing bag 7 can be adjusted.

The memory device 2 stores the following files: a medication master file; a patient master file; a usage direction master file; a diagnosis/treatment department master file; a physician master file; a packing bag's length setting file; and a medication quantity containable in packing bag setting file. The memory device 2 can act as an independent server system to form a client/server structure in network connection with the CPU 3.

The medication master file is a collection of records containing medication names together with medication codes. By the term "medication code" used here, what is meant is a sort of symbol unique to a specific medication. In other words, each medication code is a sort of abbreviation for a medication name. For instance, a medication name of "TABLET A" is used in the form of "TABA" (see FIG. 6). Further, two or more medication codes can be set with respect to a single prescription number.

The patient master file is a collection of records containing patient names together with patient codes.

The usage direction master file is a collection of records containing medication usage directions together with usage direction codes. Here, each usage direction code is determined so as to be associated with a respective medication usage direction. For instance, a usage direction code for a usage direction of "separation 3; after morning, midday, and evening meals" (which means that the patient should take his or her prescribed medication three times a day after morning, midday, and evening meals) is determined as 301.

The diagnosis/treatment department master file is a collection of records containing types of diagnosis/treatment departments together with diagnosis/treatment department codes.

The physician master files is a collection of records containing physician names together with physician codes.

As shown in Table 1, the packing bag's length setting file is made up of the following columns: a standard bag designation column; a bag length column; a maximum medication quantity column; and a maximum medicament quantity ratio (hereafter, referred to as MMQ ratio) column. The standard bag designation column is used for alternatively selecting one bag length as a standard value from a plurality of set bag lengths. The bag length is the length dimension of the packing bag 7 and in Table 1, is set at five levels at intervals of 10 mm. The maximum medication quantity column is indicative of maximum quantity of standard medication containable in each packing bag 7 with respective bag length. Each maximum medication quantity can be found easily by actually filling a target packing bag 7 with standard medications. The maximum medication quantity is indicated by the number of tablets for the case of tablet medications or by gram-weight representation for the powder medications. The term "standard medication" used in the specification means an actual medication which is regarded as a general medications among the medication used. The maximum medicament quantity (MMQ) ratio means the ratio of the maximum quantity of standard medication containable in each packing bag 7 with respective bag length to the maximum quantity of standard medication containable in the packing bag 7 designated as a standard bag.

TABLE 1

PACKING BAG'S LENGTH SETTING FILE

| Standard Bag Designation (In alternative way) | Bag Length (mm) | Standard Medication: Maximum Medication Quantity (Number of Tablets) | MMQ Ratio |
|---|---|---|---|
| — | 50 | 5 | 0.250 |
| — | 60 | 10 | 0.500 |
| — | 70 | 15 | 0.750 |
| Standard Bag | 80 | 20 | 1.000 |
| — | 90 | 25 | 1.250 |

The medication quantity containable in packing bag setting file is a collection of records for the setting of maximum medication quantities containable in the foregoing standard bag for each medication code.

TABLE 2

MEDICATION QUANTITY CONTAINABLE IN PACKING BAG SETTING FILE

| Medication Code | Maximum Medication Quantity Containable in Standard Bag (Number of Tablets) |
|---|---|
| TABA (Tablet A) | 30 |
| TABB (Tablet B) | 20 |
| CAPC (CAPSULE C) | 10 |
| . . . | . . . |

The I/O device 4 includes a keyboard 8, a mouse 9, and a CRT display 10.

Based on input signals received from the I/O device 4 and the data stored in the memory device 2, the CPU 3 exerts drive control on the medication packing mechanism part 1 for medication packing in each packing bag 7.

The host computer 5 exchanges signals, such as prescription data, with the sealing device.

Figure 3:
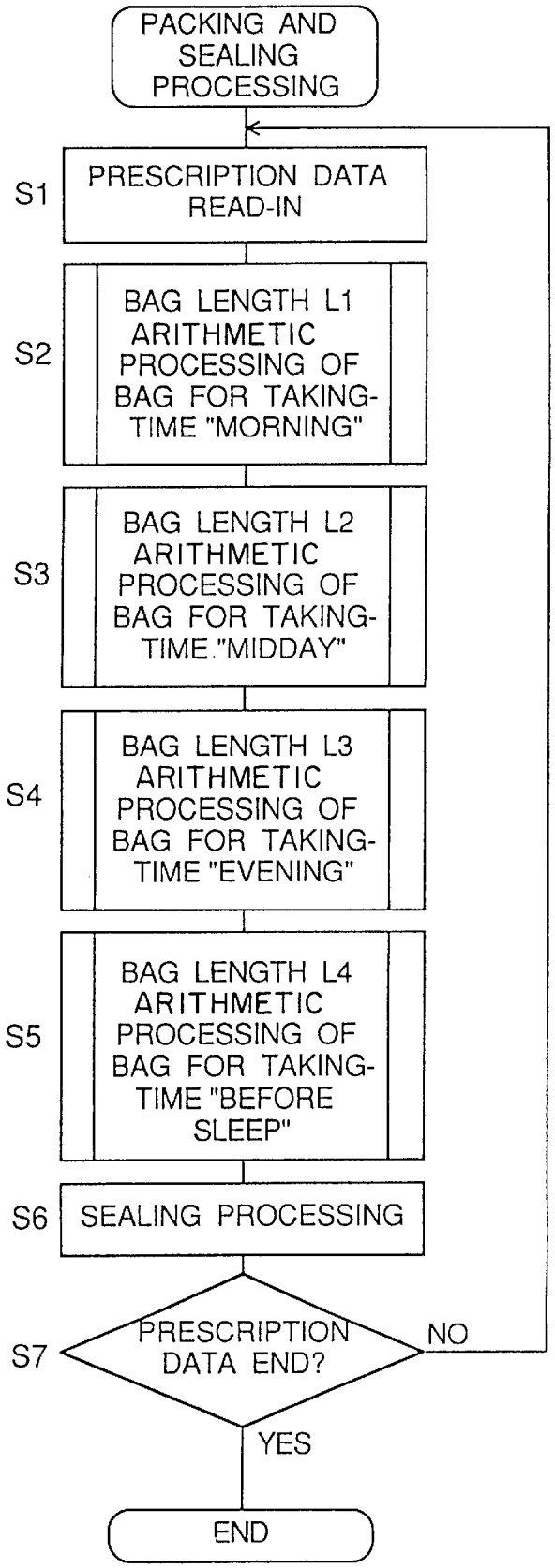
FIG. 3 is a flowchart showing packing and sealing processing in accordance with the embodiment of the present invention.

Referring now to the flowcharts of FIGS. 3–5, the sealing processing in the sealing device will be described below.

In the first place, prescription data is read in (STEP S1). This prescription data is obtained by receipt of data from the host computer 5 or by input operations from the I/O device 4. In this case, a format, shown in FIG. 6, is displayed on the screen of the CRT display 10. Upon receipt of prescription data from the host computer 5, the contents of the received prescription data are additionally displayed on the CRT display 10. However, data, received from the host computer 5, is arranged to be composed of only codes for the purpose of holding the volume of communication data as small as possible. Based on these codes, medication name data and other data are read out from the master files stored in the memory device 2. For example, if "TABA" as a medication code is contained in the received data, then "TABLET A" as a medication name is read out from the medication master file of the memory device 2.

Modification of the displayed data and addition to the displayed data can be made in easy operations from the keyboard 8 and from the mouse 9 of the I/O device 4. Any addition to the medication-taking time column can be made. For example, it is possible to add "AT THE TIME OF WAKE-UP" before "MORNING" or to add "MIDNIGHT" after "BEFORE SLEEP". Also, it is possible to divide the day by every three or four hours for modifying the frequency of taking medication (for example, a first taking time, a second taking time, and so on).

Additionally, by clicking "NEW INPUT" button in the screen of FIG. 6 to enter new data, it becomes possible to input new prescription data, while the old prescription data, which is being displayed on the screen, is deferred. For example, if a patient number of 93026671 is entered, then the patient's name, sex, and birth date are obtained from the patient master file for display on the screen. The patient's age is automatically calculated from his or her birth date and today's date.

In accordance with the present embodiment, the length (L1, L2, L3 and L4) of the packing bag 7 is determined for each of four medication-taking times, namely MORNING, MIDDAY, EVENING, and BEFORE SLEEP (STEPS S2–S5). This is followed by the process of sealing of each packing bag 7 with respective bag length (L1, L2, L3 and L4) (STEP S6). These steps are repeatedly carried out until the prescription data ends.

Figure 4:
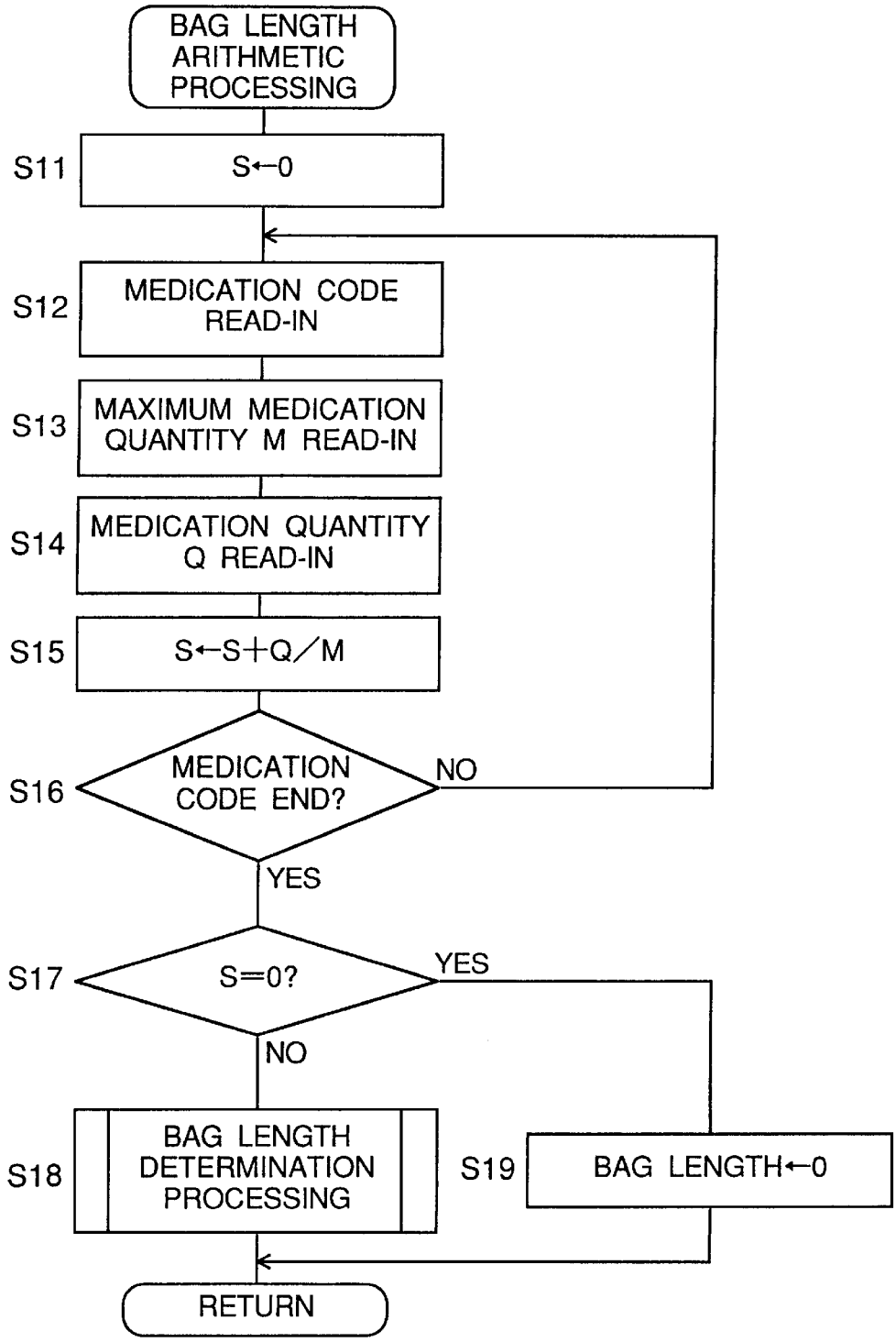
FIG. 4 is a flowchart showing the bag length arithmetic processing of FIG. 3.
Figure 5:
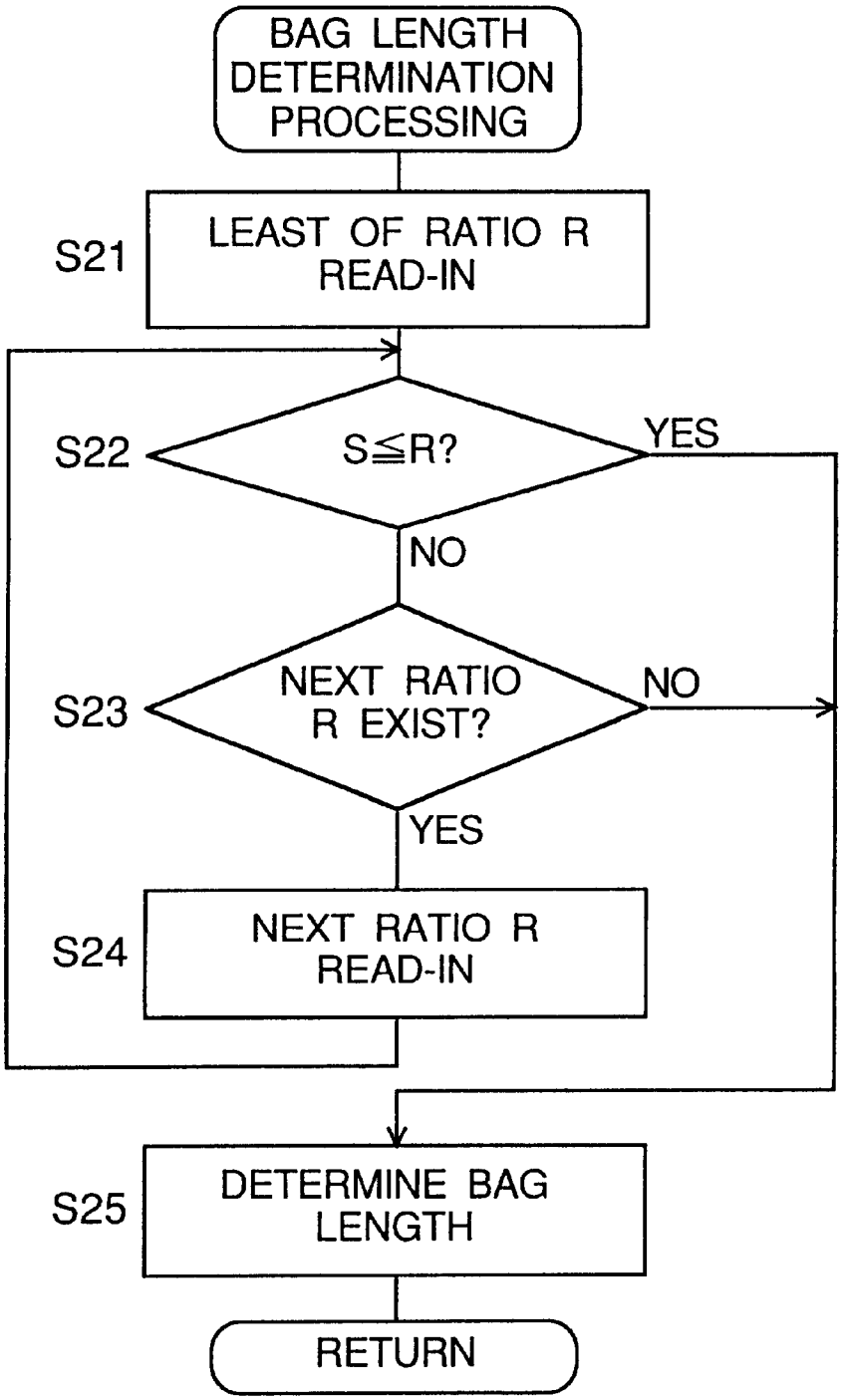
FIG. 5 is a flowchart showing the bag length determining processing of FIG. 4.

As shown in the flowchart of FIG. 4, in the bag length arithmetic processing for each medication-taking time, a sum S of containing rate is first reset to zero (S=0) at STEP S11. Thereafter, the medication code corresponding to a medication-taking time is read in from the prescription data (STEP S12).

Next, a maximum medication quantity M containable in a standard bag for the medication corresponding to the foregoing medication code is read in from the data stored in the packing bag's length setting file of the memory device 2 (STEP 13). Additionally, a medication quantity Q for the medication-taking time is read in from the prescription data (STEP S14). Thereafter, the containing rate Q/M are sequentially added according to the following equation to calculate the sum S (STEP S15).

$$S=S+Q/M$$

Such an arithmetic operation is performed on all medication codes that are read in from the host computer 5 (STEP S16). The reason for calculating the sum S of containing rate is to cope with possible cases where plural types of medications are contained in the packing bag 7.

Table 3 shows a concrete example in which a medication dose, composed of one tablet of TABLET A and two tablets of TABLET B, is prescribed for the medication-taking time MORNING. For the case of TABLET A, its maximum medication quantity for the standard bag is 30 tablets, and for the case of TABLET B, its maximum medication quantity for the standard bag is 20 tablets. Therefore, their containing rate are 1/30 and 2/20, and the sum S of containing rate is 1/30+2/20=0.133. In the same way, the containing rate are summed for the medication-taking times MIDDAY, EVENING, and BEFORE SLEEP, obtaining 0.033, 0.433 and 0, respectively.

TABLE 3

| Medication-Taking time | Calculation Process | Sum | Bag Length |
|---|---|---|---|
| Morning | Tablet A (1/30) + Tablet B (2/20) | = 0.133 (8/60) | L1 ← 50 |
| Midday | Tablet A (1/30) | = 0.033 (1/30) | L2 ← 50 |
| Evening | Tablet A (1/30) + Tablet B (2/20) + Capsule C (3/10) | = 0.433 (26/60) | L3 ← 60 |
| Before sleep | | = 0 | L4 ← 0 |

Once the sum S of containing rate is calculated, whether the calculated sum S is zero is determined (STEP S17). If the sum S of containing rate is found to be zero, this means that no packing bag is required for the medication-taking time in point, and the bag length is zero (STEP S19). Accordingly, the package length L4 for the medication-taking time BEFORE SLEEP is zero. On the other hand, if the sum S of containing rate has a given value, then bag length determining processing for the packing bag 7 is carried out according to the flowchart of FIG. 5 in the following way (STEP S18).

In the bag length determining processing of the packing bag 7, the least of the maximum medicament quantity ratio R is read in (STEP S21), and judgement is made to determine whether the least of the maximum medicament quantity ratio R exceeds the sum S of containing rate in the standard bag calculated in the foregoing way (STEP S22). Such judgement will be continued until the maximum medicament quantity ratio R exceeds the sum S of containing rate (STEPS S23–S24). When the maximum medicament quantity ratio R exceeds the sum S of containing rate, a bag length corresponding to the maximum medicament quantity ratio R is selected (STEP S25). For the case of the medication-taking time MORNING, the sum S of containing rate is 0.13, and for the case of the medication-taking time MIDDAY, the sum S of containing rate is 0.033. In each of these two medication-taking times, the sum S of containing rate falls below the least of maximum medicament quantity ratio R of 0.250. Accordingly, the bag lengths L1 (for MORNING) and L2 (for MIDDAY) are set to a value of 50 mm. On the other hand, for the case of the medication-taking time EVENING, the sum S of containing rate is 0.433, lying in the range of the maximum medicament quantity ratio R from 0.250 to 0.500. Accordingly, the bag length L3 (for EVENING) is set to a value of 60 mm.

Although, in the foregoing embodiment of the present invention, the bag length of the packing bag 7 for each medication-taking time is different, the bag lengths of the packing bags 7 may be brought to one unified value (i.e., the maximum of arithmetic operation results).

When the bag lengths for the respective medication-taking times are obtained in the way described above, the largest of the obtained bag lengths, i.e., 60 mm, is determined as a bag length for each packing bag 7. The reason is that if all packing bags have the same bag length, these bags can be placed effectively into a medication envelop by making utilization of lines of perforations formed at given positions for easy bending.

As can be seen from the above description, in accordance with a sealing device for a medication packing machine of the present invention, the bag length is determined using the sum of containing rate calculated on the basis of the type and quantity of medication for each medication-taking time. This provides advantages over the prior art. For example, the present invention is able to eliminate the need for preparing enormous amounts of data and the need for performing complicated arithmetic operations, whereby a simplified configuration can be achieved. Additionally, changes in medication type and changes in medication quantity can be dealt with ease and flexibility by changing data in point.

Further, it is arranged such that respective packing bags are formed so as to have the same bag length corresponding to the largest of the arithmetic operation results. Accordingly, checking of packaged medications becomes easy to make. In addition, putting packing bags into a medication envelop can be done effectively.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A sealing device for a medication packing machine in which an elongated packing sheet is fed in a longitudinally double-folded state and is sealed widthwise at longitudinal space intervals to form packing bags which are identical in bag width but different in bag length, for packing of medication in each of said packing bags, said sealing device comprising:

(a) memory means for storing a bag length setting file and a maximum containable medication quantity setting file, said bag length setting file containing, for each of said different bag lengths of said packing bags, a maximum medicament quantity ratio which means a ratio of the maximum quantity of standard medication containable in each packing bag with respective bag length to the maximum quantity of standard medication containable in a standard packing bag, said maximum containable medication quantity setting file containing a maximum quantity of each of other medication containable in said standard bag, (b) control means for reading a maximum containable medication quantity from said maximum containable medication quantity setting file on the basis of the type and quantity of medication for each medication-taking time in prescription data, calculating a sum of containing rate of the medicament in the standard bag, determining a bag length on the basis of said sum of containing rate and said maximum medicament quantity ratio stored in said bag length setting file, and sealing the medication bag in said bag length and packing said medication in said medication bag.

2. The sealing device as defined in claim 1, wherein data contained in each of said files stored in said storage means can be changed by input means.

3. The sealing device as defined in claim 1, wherein said calculated bag lengths, which are the results of said calculations, are bought to one unified value equal to the maximum of said calculation results and all packing bags are formed having a bag length corresponding to said maximum value.

* * * * *